US006590499B1

(12) United States Patent
D'Agosto

(10) Patent No.: US 6,590,499 B1
(45) Date of Patent: Jul. 8, 2003

(54) MONITOR ALARM FOR DETECTING VEHICLE DRIVER'S SLEEPINESS

(76) Inventor: Joseph D'Agosto, 95 Fitch Ave., Darien, CT (US) 06820

( * ) Notice: Subject to any disclaimer, the term of this patent is extended or adjusted under 35 U.S.C. 154(b) by 0 days.

(21) Appl. No.: 10/061,741

(22) Filed: Feb. 4, 2002

(51) Int. Cl.[7] ..... G08B 23/00

(52) U.S. Cl. ..... 340/575; 73/379.02; 73/379.08; 180/272; 340/439; 340/573.1; 340/576; 340/665

(58) Field of Search ..... 340/439, 573.1, 340/575, 576, 665; 180/272; 73/379.01–379.09, 818, 824, 841, 856

(56) References Cited

U.S. PATENT DOCUMENTS 3,585,626 A * 6/1971 Tartarini ..... 180/272
3,703,217 A * 11/1972 Kulick et al. ..... 180/272
4,485,375 A * 11/1984 Hershberger ..... 340/576
4,540,979 A * 9/1985 Gerger et al. ..... 340/576
4,617,559 A * 10/1986 Slansky ..... 340/576
5,453,929 A * 9/1995 Stove ..... 701/1
5,463,258 A * 10/1995 Filion et al. ..... 307/10.1
5,585,785 A * 12/1996 Gwin et al. ..... 340/575
5,874,892 A * 2/1999 Antonellis et al. ..... 340/438
5,969,616 A * 10/1999 Tschoi ..... 340/576
6,218,947 B1 * 4/2001 Sutherland ..... 340/576

* cited by examiner

*Primary Examiner*—Daniel J. Wu
*Assistant Examiner*—Lam Pham
(74) *Attorney, Agent, or Firm*—Alfred E. Miller

(57) ABSTRACT

An arrangement for monitoring and detecting a sleeping driver incorporating a load cell connected to electronic scales for establishing a base line force value when a driver grasps the steering wheel so that when the driver relaxes the grip on the steering wheel and the force value falls below the established base line value an alarm is sounded.

6 Claims, 3 Drawing Sheets

MONITOR ALARM FOR DETECTING VEHICLE DRIVER'S SLEEPINESS

The present invention relates to an apparatus co-acting with a vehicle steering wheel for detecting a sleeping or dozing driver and providing an alarm system for awaking the driver.

The prior art shows different devices, which function as sleep detectors for drivers of vehicles. In this regard U.S. Pat. No. 6,172,610 to Prus discloses a sleepy driver detection and alarm system, which includes contacts for measuring skin resistance, and is provided with a micro-controller for determining a baseline resistance. The alarm is sounded, waking the driver, when the resistance varies from the baseline. The arrangement is believed to be unreliable since the ambient temperature differences effect perspiration and will alter the skin resistance readings. U.S. Pat. No. 6,218,947 to Sutherland is directed to a sleep detector having a sensed capacity between the two plates on a steering wheel rim. When the driver's fingertips are released from the steering wheel an alarm is sounded. U.S. Pat. No. 4,210,905 to Coons shows a plurality of switches arranged around a vehicle steering wheel. The switches remain open as long as the driver grasps the steering wheel, however if the driver loosens his grip on the steering wheel as he dozes the switch will close making a complete circuit that activates an alarm. The prior art solutions to detect a driver who is about to fall asleep are not reliably sensitive or repeatable.

This invention incorporates the use of a sensitive load cell to measure the driver's grasp of the vehicles steering wheel, and using that value as a base line for detecting a driver's sleepiness. The load cell utilized is a force transducer, which converts a force into an electric signal. The present load cell is used to measure compression applied by the user's hands to a steering wheel. In effect, the steering mechanism would have the attribute of an electronic scale.

The detection and alarm system for a dozing or sleeping automobile driver of the present invention can be individualized so that each individual who grasps a steering wheel to operate a vehicle will establish a base line value of weight on the steering wheel which remains as that individual's signature value. Consequently, any variations below that value will activate an alarm, which may be audible as well as visual. The detection means is a load cell which may take the form of a strain gage having a sensitive spring element that responds to direct stress, bending or shear caused by the driver's firm grasp of an automobile steering wheel. In this connection, for example, the steering wheel could be zeroed when the ignition is turned on. The driver would then take hold of the steering wheel in a natural grip. The force applied to the steering wheel would then be placed in the memory of the apparatus.

It should be noted that the present detection system could be delayed in operation until the vehicle reaches higher speeds, such as 55 mph. Thus, the apparatus can be deployed at higher speeds in order to avoid serious accidents at such elevated speeds. It is also contemplated to provide an automatic reset of the detection and alarm system after ignition is started in the vehicle. The grasp of the driver can be quantitated and reported back to the driver and occupant by a visual and audible scale, setting up a positive feedback loop, in effect placing the driver in tune with the vehicle and the vehicle in tune with the driver.

DESCRIPTION OF THE DRAWINGS

In order that the invention may be more clearly understood, it will now be disclosed in greater detail with reference to the accompanying drawings in which.

DESCRIPTION OF THE PREFERRED EMBODIMENT

Figure 1:
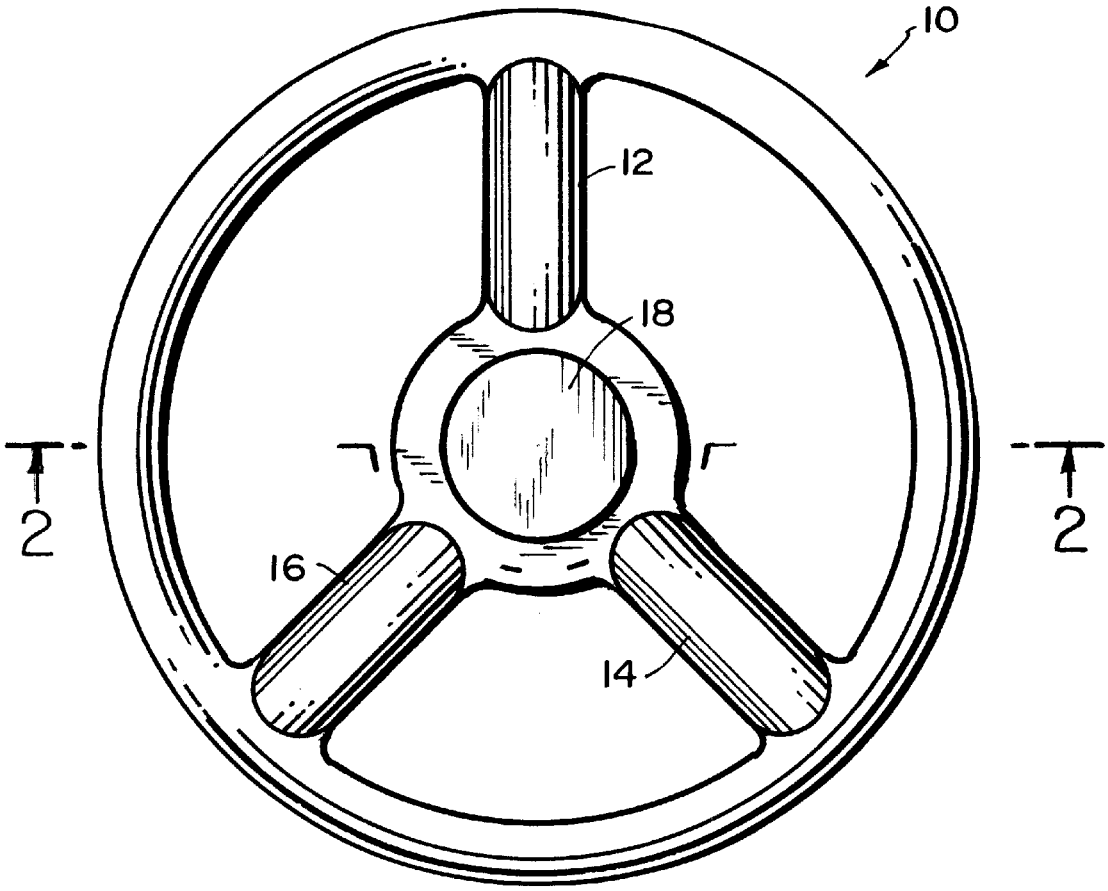
FIG. 1 is a front elevational view of a vehicle steering wheel, which incorporates a novel driver sleep detector and alarm constructed in accordance with the teachings of my invention.
Figure 2:
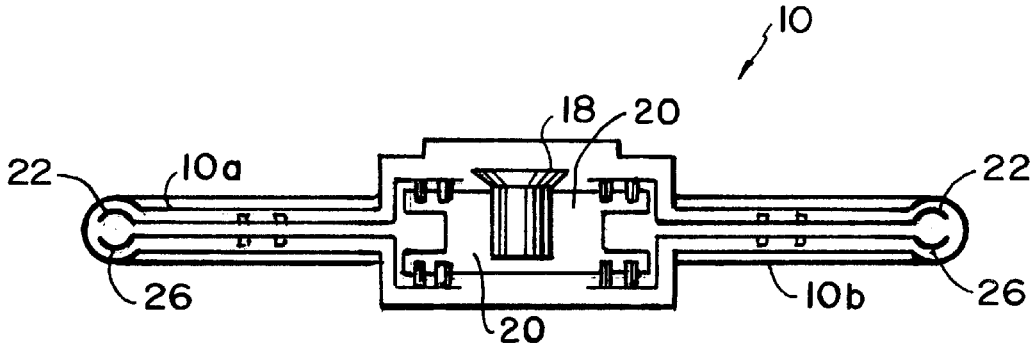
FIG. 2 is a view taken along the lines 2—2 of FIG. 1 showing the features of my invention in more detail.
Figure 3:
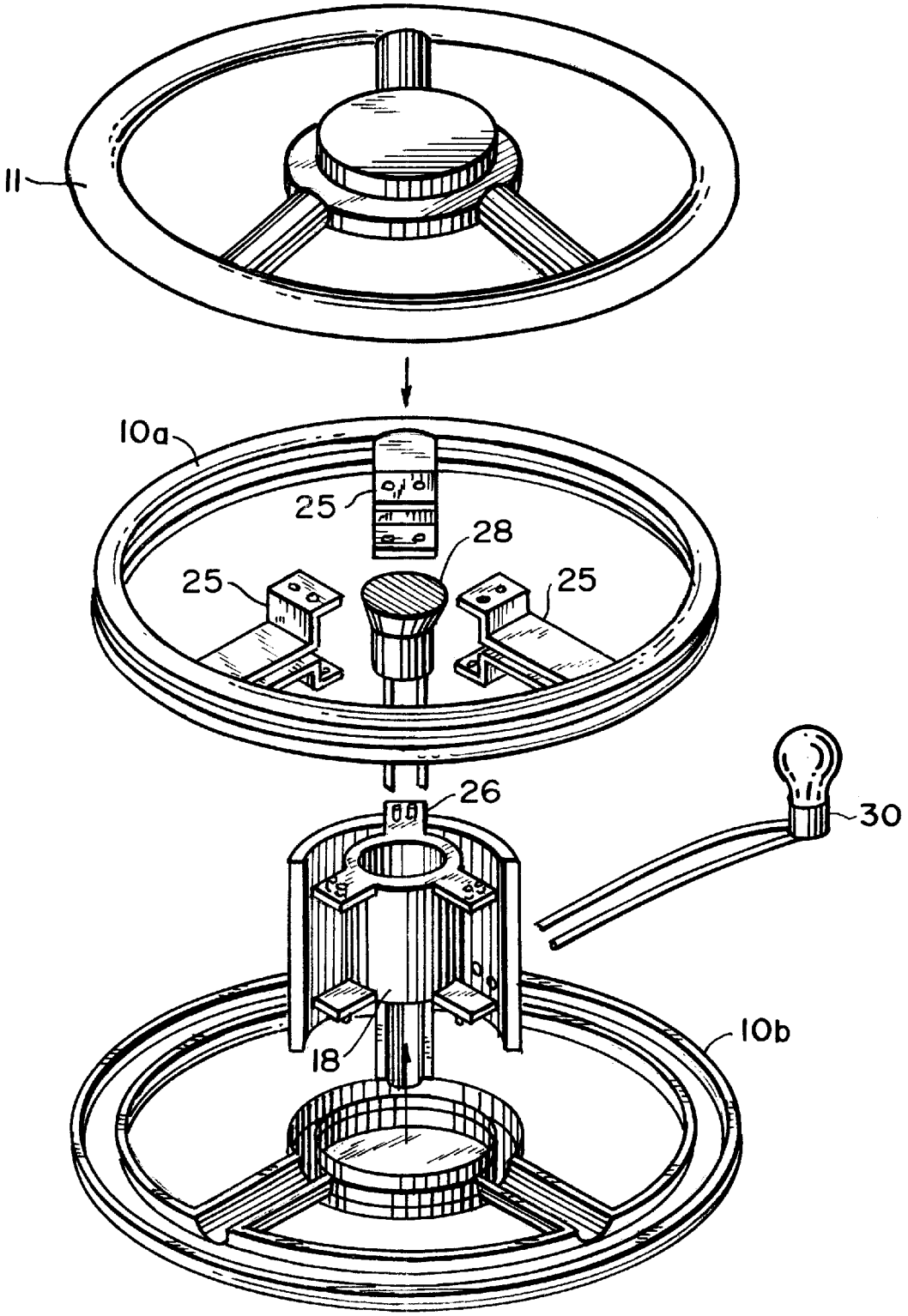
FIG. 3 is an exploded view showing my invention prior to assembly.

Referring to FIGS. 1–3 a vehicle steering wheel referred to generally by the numeral 10, is shown having spokes 12, 14 and 16 and a hub 18 in which the horn and driver airbag is accommodated. The steering wheel has a top circular portion 10*a* and a bottom portion 10*b* which is correspondingly circular to the top portion thereof.

As seen in FIG. 2, my present arrangement incorporates a load cell 20 and that is connected to an upper half of scale 22 located underneath and adjacent to the top circular portion 10*a* of the steering wheel. The load cell 20 is connected to the lower half of the scale 26 above the circular portion 10*b* of the steering wheel. It should be noted that the load cell is positioned within the hub 18 of the steering wheel while scale halves 22 and 26 are located in the upper and lower portions of the steering wheel with the connections between the load cell and the scales extending through said spokes. Mounting means 25 are shown for the load cell 20. The top portion 10*a* and the bottom portion 10*b* of the steering wheel, when assembled, are covered by a steering wheel cover 11 which may be leather-wrapped for improved appearance. Thus, when the driver initially grasps the steering wheel in a driving mode, the sensitive shear stress members of the load cell records a weight value based upon the force applied which is stored in a memory. It should be noted that the force applied to the combined top as well as the bottom of the steering wheel is recorded as a specific base line value for each of the drivers of a vehicle.

FIG. 3 is an exploded view of my invention of a vehicle steering wheel encompassing the invention having a top portion 10*a* of the steering wheel and a bottom portion 10*b*. Connected to 10*a* and 10*b* of the steering wheel is load cell 20 mounted in brackets 25 that in turn are connected to sensor 26 of the load cell that activate both the audible alarm 28 and the visual light indicator 30.

Figure 4:
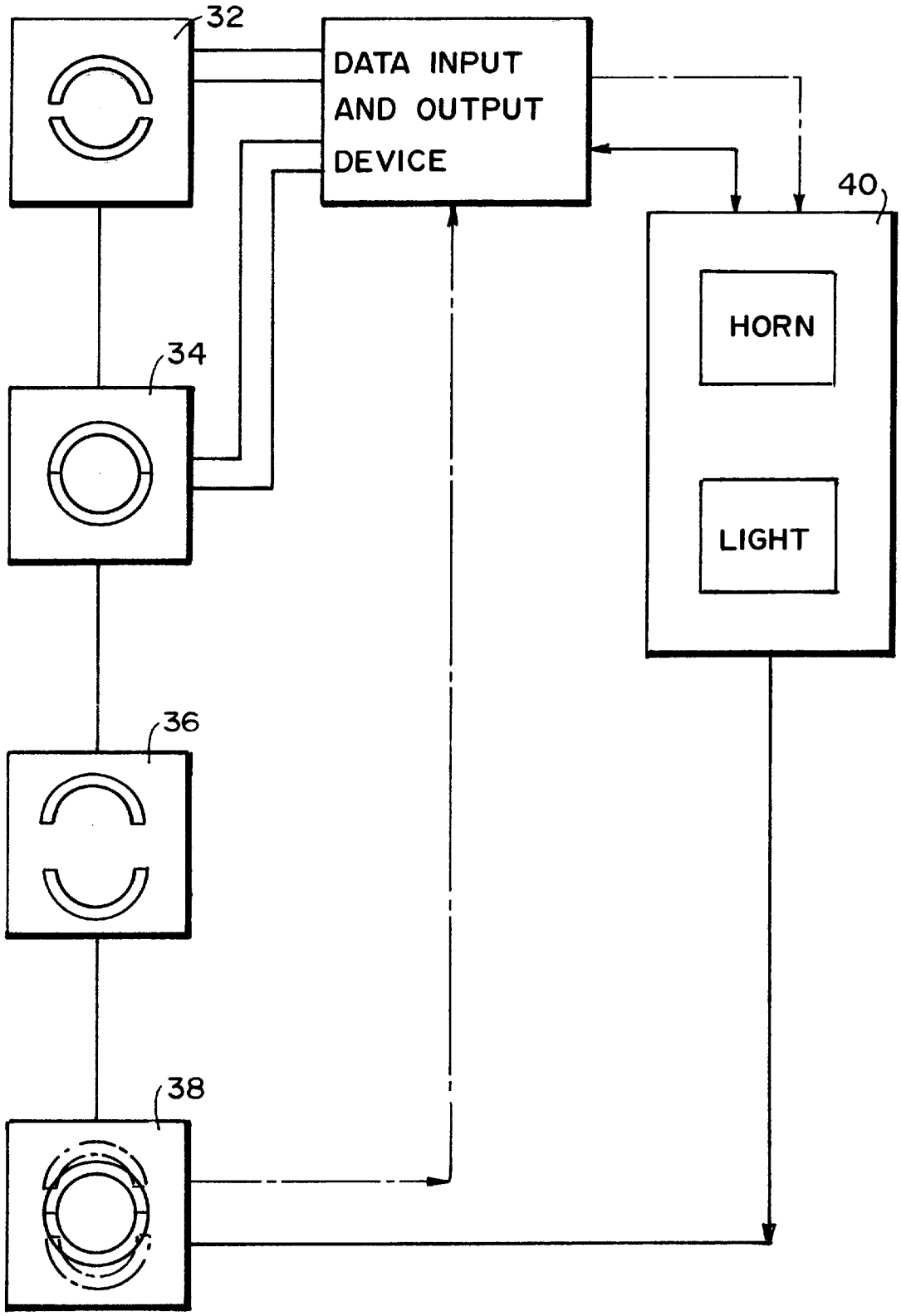
FIG. 4 is a flow chart of the monitoring circuit of my sleep detector.

FIG. 4 is a flow chart of the initiation and operation of the present arrangement for waking a dozing or sleeping vehicle driver in which the system is shown at rest-off at 32. When the driver grasps the steering wheel, as shown at 34, the weight value baseline on the steering wheel is recorded. When the force value on the steering wheel falls below the recorded baseline value the system is activated at 38 and when sleep occurs at 36 the circuit is closed thereby causing the horn and/or light 40 to be activated resulting in waking the sleeping driver.

While there has been shown and described an embodiment of the present invention. it will be understood that various changes in the form and details of the device illustrated and in its operation may be made by those skilled in the art without departing from the spirit of the invention. It is my intention, therefore, to be limited only as indicated by the scope of the claims appended hereto.

What is claimed is:

1. A detector and alarm system for a sleeping driver associated with a vehicle steering wheel comprising said steering wheel having an upper circular part and lower circular part, a first electronic scale operatively connected to said upper circular part, a second electronic scale operatively connected to said lower circular part, a load cell operatively connected to said first and second electronic scales, a sensor, a data recording device receiving a weight value being applied to said upper and lower circular parts of said steering wheel by the driver grasping said steering wheel which is recorded by said sensor as a base line value in said data recording device, an alarm connected to said data recording device whereby when the force applied to the steering wheel is less than said base line value said alarm is activated to awaken said sleeping driver.

2. A detector and alarm system as claimed in claim 1 wherein said steering wheel is provided with a hub and said load cell being mounted in said hub.

3. A detector and alarm system as claimed in claim 1 wherein said alarm is the vehicle audible alarm.

4. A detector and alarm system as claimed in claim 1 wherein said alarm is a light.

5. A detector and alarm system for a sleeping driver associated with a vehicle steering wheel, comprising said steering wheel having an upper half part and a lower half part, an upper scale, a lower scale, each associated with said upper and lower half parts, a load cell each connected to the respective upper and lower half parts of said steering wheel whereby when said driver initially grasps said steering wheel the force applied to the scale on said upper and lower half parts is recorded as a base line value, and when said driver relaxes his grip on the steering wheel and the force applied to said steering wheel is less than the base line value an alarm is activated to awaken said sleeping driver.

6. A detector and alarm system as claimed in claim 5 wherein each of said scales are electronic.

* * * * *